US005667127A

United States Patent [19]

Ichikawa et al.

[11] Patent Number: 5,667,127

[45] Date of Patent: Sep. 16, 1997

[54] ADJUSTMENT MECHANISM FOR ADJUSTING DEPTH AT WHICH PNEUMATIC NAILING MACHINE DRIVES NAILS INTO WORKPIECE

[75] Inventors: Kaoru Ichikawa; Kunio Yamamoto; Yoshitaka Akiba, all of Hitachinaka, Japan

[73] Assignee: Hitachi Koki Co., Ltd., Tokyo, Japan

[21] Appl. No.: 399,466

[22] Filed: Mar. 7, 1995

[30] Foreign Application Priority Data

Apr. 15, 1994 [JP] Japan ..... 6-077284

[51] Int. Cl.[6] ..... B25C 1/04

[52] U.S. Cl. ..... 227/142; 227/8

[58] Field of Search ..... 227/120, 130, 227/8, 142

[56] References Cited

U.S. PATENT DOCUMENTS

| | | | |
|---|---|---|---|
| 4,838,471 | 6/1989 | Chiesa | 227/142 |
| 5,219,110 | 6/1993 | Mukoyama | 227/142 |
| 5,263,842 | 11/1993 | Fealey | 227/8 |
| 5,385,286 | 1/1995 | Johnson, Jr. | 227/142 |

FOREIGN PATENT DOCUMENTS

| | | | |
|---|---|---|---|
| 1603827 | 1/1972 | Germany . | |
| 4032231 | 6/1991 | Germany . | |
| 4433746 | 3/1995 | Germany . | |
| 352083 | 5/1991 | Japan | B25C 7/00 |

*Primary Examiner*—Rinaldi I. Rada
*Assistant Examiner*—Boyer Ashley
*Attorney, Agent, or Firm*—Sughrue, Mion, Zinn, Macpeak & Seas

[57] ABSTRACT

A pneumatic nailing machine having a, driving depth controlling mechanism. The pneumatic nailing machine includes a push lever having a lower end in pressure contact with a workpiece and another end in association with a trigger. Vertical moving length of the push lever relative to a nose will change the driving depth. An eccentric body is rotatably supported on the main body. The eccentric body is positioned above the upper tip of the push lever and the upper position of the upper tip of the push lever is regulated by the eccentric body. If the eccentric body is angularly rotated to a first angular position, the push lever can be moved to its highest position for providing a minimum distance between the lower tip of the push lever and a lower tip of the nose to provide the maximum driving depth. If the eccentric body is angularly rotated to a second angular position, the distance between these tips become maximum to provide a minimum driving depth. If the eccentric body is rotated to a third angular position, the trigger is abuttable on the upper tip of the push lever for preventing pivotal movement of the trigger.

10 Claims, 6 Drawing Sheets

ADJUSTMENT MECHANISM FOR ADJUSTING DEPTH AT WHICH PNEUMATIC NAILING MACHINE DRIVES NAILS INTO WORKPIECE

BACKGROUND OF THE INVENTION

The present invention relates to a pneumatic nailing machine having a mechanism for regulating a driving depth of nails or other fasteners into a workpiece.

It is desirable that the driving depth at which a pneumatic nailing machine drives nails into a workpiece be adjustable. When nails are driven into the workpiece too deeply, the surface of the workpiece around the nail head can be indented by the nail head, resulting in a pitted and uneven workpiece surface. On the other hand, if the driving depth is insufficient, the nail head is projected or separated from the top surface of the workpiece.

Japanese Utility Model Application Kokai No. HEI-3-52083 describes such a conventional pneumatic nailing machine wherein the driving depth is adjustable. As shown in FIG. 1, the conventional pneumatic nailing machine 101 has a body 102 with a nose portion 108. A trigger 112 is pivotally movably provided to the body 102, and an operation lever 142 is pivotally movably provided to the trigger 112. A trigger valve 110 is provided for providing a pneumatic force to a piston 106, and a plunger 111 is provided to actuate the trigger valve 110. If the operation lever 142 is pivotally moved to a pivot position, the operation lever 142 can be abuttable on the plunger 111, so that the trigger valve 110 is actuated upon manipulation to the trigger 112. On the other hand, if the operation lever 142 is in a rest position, the operation lever 142 does not abut the plunger 111 even by the manipulation to the trigger 112. The pivotal movement of the operation lever 142 is provided by a vertical movement of a support shaft 140.

A push lever 114 is provided attached to the nose 108 of the body 102. As shown in FIGS. 2 through 4, the push lever 114 has two sections: a first push lever 128 and a substantially L-shaped second push lever 129 connected to the support shaft 140. A bearing collar 132 is provided to the second push lever 129. An elliptical hole 123 formed elongated in the direction horizontal to the vertically elongated shape of the push lever 114 is provided opened in the first push lever 128.

A connection unit 131 is provided for slidably connecting the first push lever 128 to the second push lever 129. The connection unit 131 includes an adjustment mechanism 117 and a support unit 130. The adjustment mechanism 117 includes an adjustment shaft 118 that is rotatably supported engaged in the bearing collar 132. A flange 119 is provided on the end of the adjustment shaft 118 that faces the nose 108. A knob 120 for rotating the adjustment shaft 118 is provided to the opposite end of the adjustment shaft 118. The adjustment mechanism 117 also includes an eccentric body 121 provided fixed around the lengthwise center of the adjustment shaft 118, between the knob 120 and the bearing collar 132, so as to rotate in association with the rotation of the adjustment shaft 118. The eccentric body 121 is also engaged in the elliptical hole 123 of the first push lever 128. With this configuration, rotation of the eccentric body 121 moves the first push lever 128 vertically in relation to the second push lever 129.

The support unit 130 ensures vertical orientation of the first push lever 128 even by the eccentric rotation of the eccentric body 121. That is, the first push lever 128 is formed with a first slot **128*a* and a second slot 128*b*, and the support unit 130 includes a screw 150 fixedly secured to the second push lever 129 and extending through the first slot 128*a*, and a protrusion 151 extending from the second push lever 129 into the second slot 128*b*. Accordingly, vertical movement of the first push lever 128 by the rotation of the eccentric body 121 is guided by the sliding engagement between the screw 150 and the first slot 128*a* and between the protrusion 151 and the second slot 128*b***.

The operation lever 142 for preventing or allowing the trigger 112 to be pulled is pivotally provided in a trigger 112. A guide member 141 with a vertically running cylindrical bore opened therein is provided to the body 102 beneath the trigger 112. The support shaft 140 is supported in the bore of the guide member 141 so as to be vertically slidable therein.

A screw 160 for fixing the push lever 114 to the support shaft 140 is fixed to the tip of the vertical arm of the substantially L-shaped second push lever 129. With this configuration the support shaft 140 protrudes from the guide member 141 and abuts the free tip of the operation lever 142 when the push lever 114 is moved upwardly, that is, when the lower end 115 of the first push lever 128 is forcibly pressed against the workpiece surface.

With this conventional mechanism for adjusting the driving depth, the distance at which the tip of a driving rod 105 protrudes from the pneumatic nailing machine is adjusted by adjusting the length of the push lever 114. The push lever 114 is elongated or shortened by rotating the adjustment mechanism 117 near the nose 108, thereby adjusting the distance between the tip of the push lever 115 and the tip surface 109 of the nose 108.

When the eccentric body 121 is in the posture shown in FIG. 2, the first push lever 128 is raised as high as allowed by the adjustment mechanism 117. The overall length of the push lever 114 is at a minimum, which results in nails being driven into the workpiece to the maximum possible depth. On the other hand, when the eccentric body 121 is in the posture shown in FIG. 4, the overall length of the push lever 114 is at a maximum, which results in nails being driven into the workpiece to the minimum possible depth because the distance between the nose tip surface 109 and the push lever tip surface 115 becomes the longest.

However there has been known a problem with this conventional adjustment arrangement in that because the adjustment mechanism 117 is located near the nose 108, an operator can not reach the adjustment mechanism 117 with the same hand that holds the handle 103 while holding the handle 103. The adjustment mechanism 117 can be operated by the other hand (i.e., the hand not holding the handle 103), but when the operator is holding the workpiece in place during nail driving operations, the operator must release the workpiece to adjust the adjustment mechanism 117. Therefore, the adjustment mechanism 117 can not be operated during operations wherein the workpiece must be held in place by hand.

Also, the adjustment mechanism 117 gets in the way during operations in confined areas, such as in corners because of its position near the nose 108. Additionally, the connection unit 131 is necessary because the push lever 114 is formed from the first push lever 128 and the separate second push lever 129. This increases the complexity of the device.

Further, the pneumatic nailing machine may be accidentally fired if the push lever 114 is accidentally pressed against a solid object while the trigger 112 is being pulled in a sequential nail driving operation. This is due to the fact that the trigger 112 is always manipulatable regardless of the nail driving operation. Therefore, if the push lever 114 is depressed to move the support shaft 140 upwardly, a nail is driven if the trigger is inadvertently manipulated.

SUMMARY OF THE INVENTION

It is an object of the present invention to provide an improved pneumatic nailing machine having a depth adjustment mechanism by which the depth at which nails are driven into a workpiece can be adjusted with one hand.

Another object of the present invention is to provide the pneumatic nailing machine with a slim nose area so that operations in narrow areas such as corners can be easily performed.

Still another object of the present invention is to provide the pneumatic nailing machine in which its depth adjustment mechanism has a simple structure on which maintenance can be easily performed.

Still another object of the present invention is to provide the pneumatic nailing machine in which the depth adjustment and prevention of accidental firing can be performed by the same component or components.

These and other objects of the present invention can be attained by providing a pneumatic nailing machine for driving a nail into a workpiece, the pneumatic nailing machine including a main body, a handle extending from the main body, a nose, a trigger, a push lever, a driving rod, and a nail driving depth control mechanism. The nose is provided to the main body, and the nail is protrudable from the nose by the driving rod. The trigger is pivotally supported to the main body and is positioned close to the handle for starting a nail driving operation. The push lever is vertically movably supported to the main body. The push lever has a lower tip portion positioned near the nose and an upper tip portion positioned near the trigger. The driving rod is supported in the main body and is movable in an axial direction thereof. The driving rod is movable along the nose upon manipulation to the trigger. The nail driving depth controlling mechanism is adapted for controlling a distance between a lower tip end of the nose and a lower tip end of the push lever when the push lever is pressed against the workpiece. The nail driving depth controlling mechanism has an adjustment mechanism which defines an uppermost moving end position of the push lever. The adjustment mechanism is positioned near the handle and above the trigger.

BRIEF DESCRIPTION OF THE DRAWINGS

The above and other objects, features and advantages of the invention will become more apparent from reading the following description of the preferred embodiment taken in connection with the accompanying drawings in which:

FIG. 8(*b*) is a view illustrative of a flushing state between tips of a push lever and a nose and of the maximum driving depth;

FIG. 9(*b*) is a view illustrative of the minimum driving depth; and

DETAILED DESCRIPTION OF THE PREFERRED EMBODIMENTS

A pneumatic nailing machine having a depth adjustment mechanism according to a preferred embodiment of the present invention will be described with reference to FIGS. 5 through 10.

Figure 5:
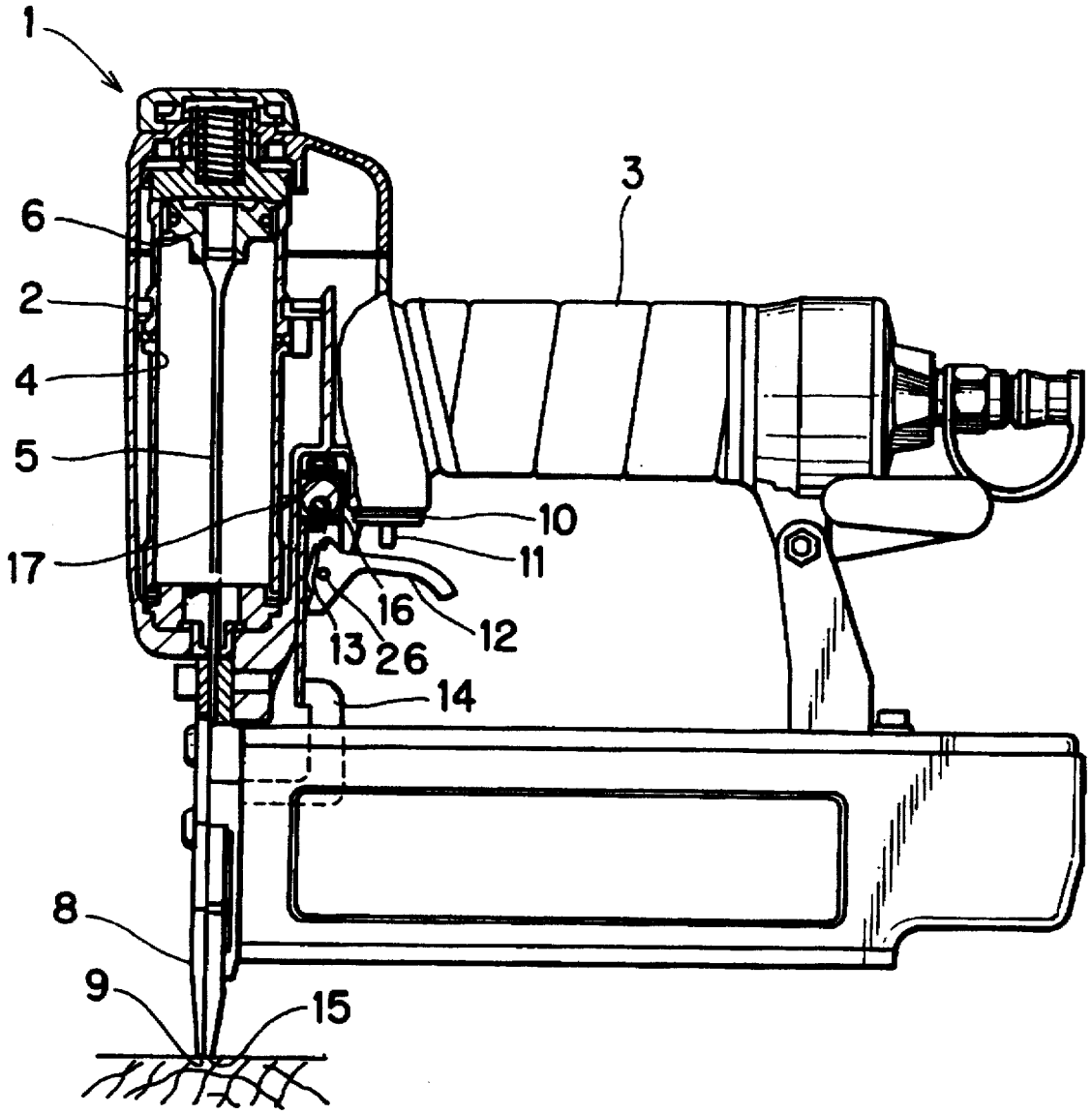
FIG. 5 is a front view partly cross-sectioned showing a pneumatic nailing machine according to a preferred embodiment of the present invention.

As best shown in FIG. 5, the pneumatic nailing machine 1 includes a body 2 provided with an internal cylinder 4. A handle 3 is connected to the body 2. As is well known, a piston 6 to which is fixed a drive punch 5 is slidingly engaged in the cylinder 4. A nose 8 for guiding vertical movements of the drive punch 5 is formed at the tip of the body 2. The tip of the drive punch 5 is provided reciprocally movable through the nose 8. A magazine 7 for housing nails is supported by the body 2 and the handle 3. Nails in the magazine 7 are sequentially fed to a nail driving passage 8C (FIG. 6) formed in the nose 8.

A trigger valve 10 for controlling flow of compressed air to the cylinder 4 is provided to the handle 3 near the body 2. A plunger 11 is provided in the trigger valve 10 so that its tip protrudes from beneath the handle 3. A trigger 12 is attached to the body 2 by a pin 26 so as to be pivotable on the pin 26. The upper surface of the trigger 12 is shaped with a protrusion 13. An adjustment mechanism 17 (to be described in detail later) is provided above the protrusion 13 of the trigger 12.

Figure 6:
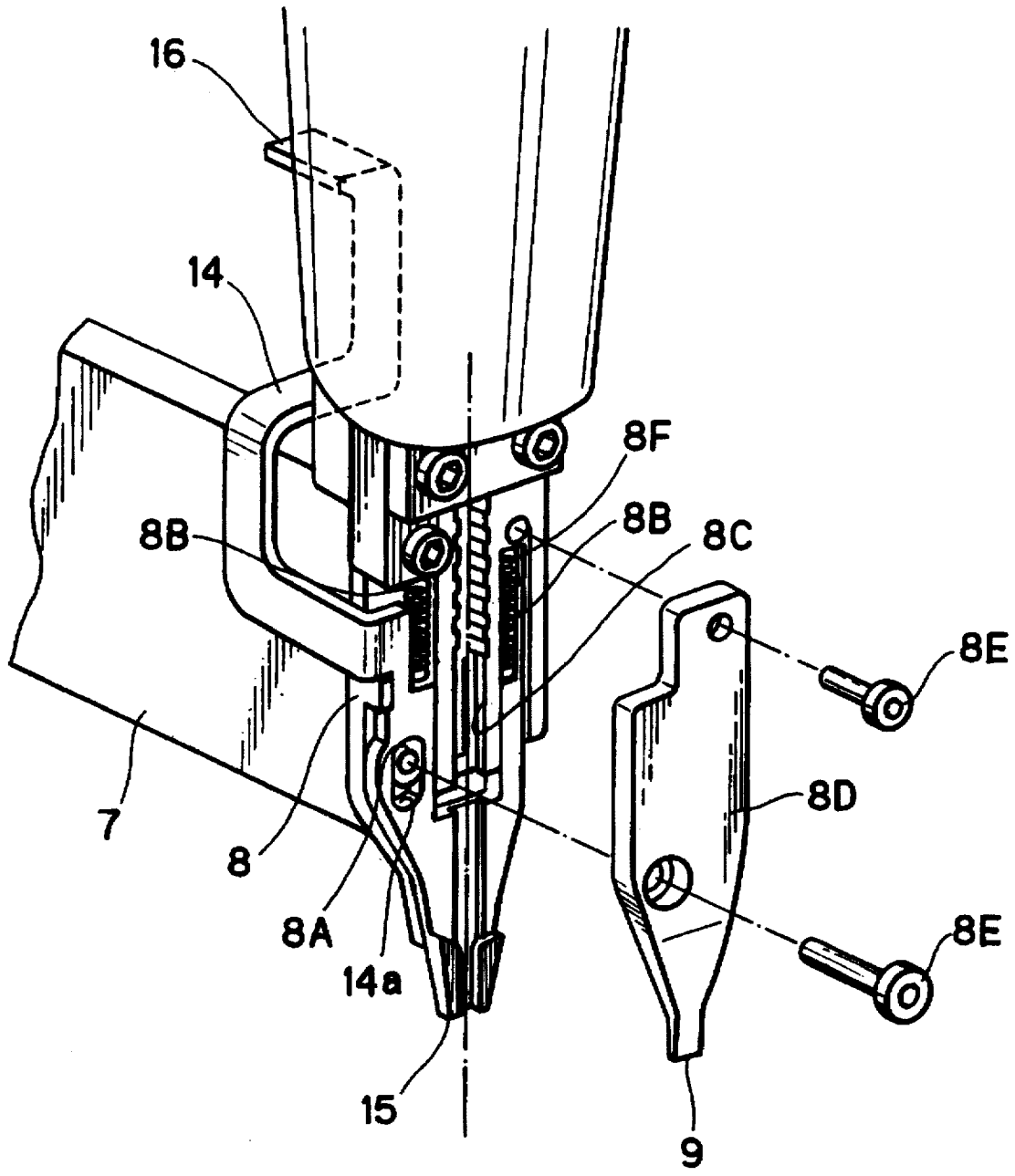
FIG. 6 is an exploded perspective view showing a nose portion and a push lever in the preferred embodiment.

As shown in detail in FIG. 6, an integral push lever 14 with a substantially inverted L-shaped upper tip 16 and a lower tip 15 is provided so that its upper tip 16 is positioned between the protrusion 13 and an adjustment mechanism 17 and so that its lower tip 15 follows the contour of the nose 8. The push lever 14 is formed in a shape that follows the cross-sectional contour of the magazine 7 as best shown in FIG. 6. The push lever 14 is disposed slidably relative to the nose 8. That is, the nose 8 has a projection 8A and is formed with a pair of vertical slots 8B and the nail driving passage 8C. Further, a nose cover 8D is provided which is secured to the nose body 8 by screws 8E. On the other hand, the push lever 14 is formed with a slot 14*a* with which the projection 8A is engaged. Thus, the push lever 14 is vertically movable within the stroke defined by the length of the slot 14*a*. A pair of springs 8F are provided in the pair of vertical slots 8B for urging the push lever 14 downward so that the lower tip 15 protrudes past the nose 8 and so that the upper tip 16 engages with the protrusion 13 of the trigger 12. While the upper tip 16 is engaged with the protrusion 13, the trigger 12 can not be pulled into abutment with the plunger 11.

Figure 7:
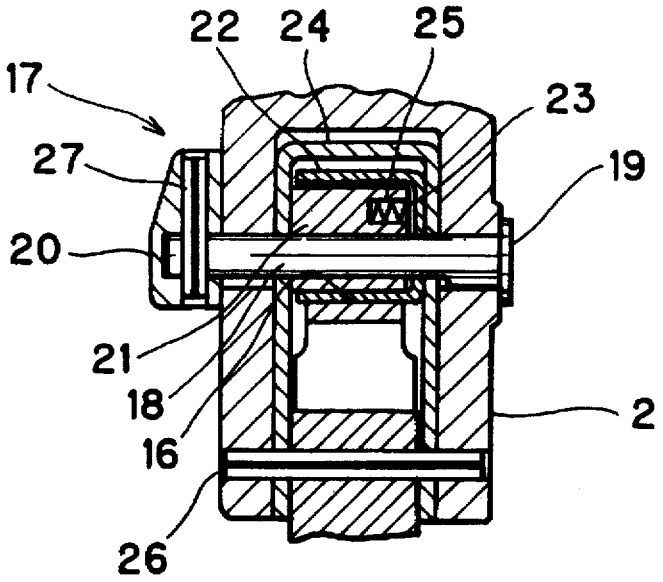
FIG. 7 is a cross-sectional view taken along the line VII—VII in FIG. 8(*a*) showing an essential portion of an adjusting mechanism in the driving depth control arrangement according to the embodiment of this invention.
Figure 8A:
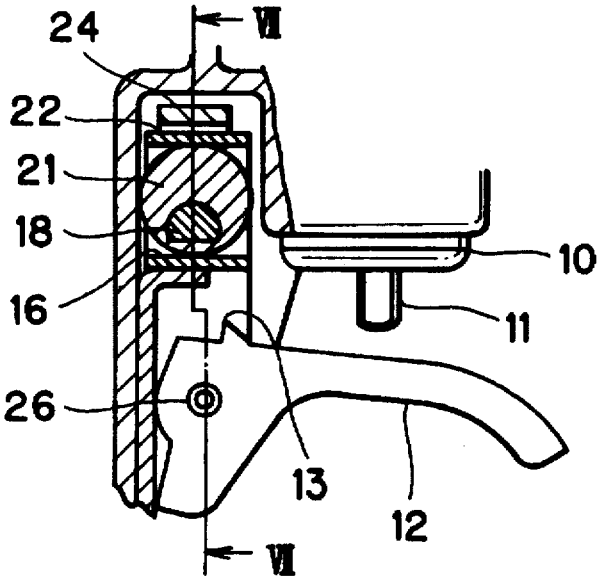
FIG. 8(*a*) is a cross-sectional view showing the highest position of a first guide according to the embodiment.
Figure 8B:
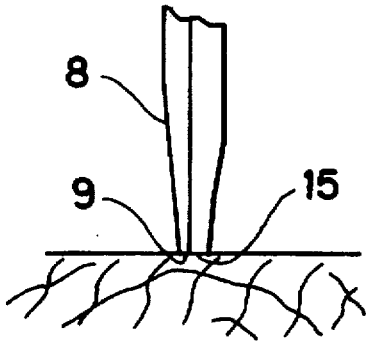

A nail driving depth controlling mechanism will be described. This mechanism is adapted for controlling a distance between the lower tip end 9 of the nose 8 and the lower tip end 15 of the push lever 14 when the push lever 14 is pressed against the workpiece. The nail driving depth controlling mechanism includes the adjustment mechanism 17 provided above the trigger 12 and close to the handle 3 so as to define or regulate an uppermost moving end position of the push lever 14. As can be seen in FIGS. 7 and 8(*a*), the adjustment mechanism 17 includes an adjustment shaft 18 supported in a bore through the body 2 so as to be freely rotatable. A knob 20, for rotating the adjustment shaft 18, and a flange 19 are provided to opposite tips of the adjustment shaft 18. The knob 20 is fixed to the adjustment shaft 18 by a pin 27. The adjustment shaft 18 can be removed by pulling out the pin 27 and detaching the knob 20 from the adjustment shaft 18. The adjustment shaft 18 has a semicircular cross-sectional portion.

An eccentric body 21 is provided fitted over the semicircular cross-sectional portion of the adjustment shaft 18, so that the body 21 becomes integral with the shaft 18. Therefore, the eccentric body 21 is rotatable by the rotation of the adjustment shaft 18. Maintenance is simplified with this structure because the eccentric body 21 can be easily removed from the adjustment shaft 18 by relative axial displacement.

A first guide 22 with a reclining U-shape is provided so as to surround three sides of the eccentric body 21. The U-shape wall is formed by bending a flat plate. An oval-shaped slot 23 is formed in the first guide 22 on its surface that is perpendicular to lengthwise dimension of the adjustment shaft 18. A spring 25 for urging the eccentric body 21 in the direction of the knob 20 is provided inserted in the slot 23. The first guide 22 is engaged in the body 2 so as to slide vertically in association with rotation of the eccentric body 21. When the tip 15 of the push lever 14 is pressed against a workpiece as shown in FIG. 5, the push lever 14 rises until its upper tip 16 abuts against the first guide 22, whereupon further upward movement of the push lever 14 is prevented.

A second guide 24 for guiding sliding movements of the first guide 22 and the push lever 14 is attached to the outer periphery of the first guide 22 by a pin 26 and the adjustment shaft 18. The second guide 24 is formed with surface irregularities where the knob-side surface of the eccentric body 21 abuts the second guide 24. Similarly, the knob-side surface of the eccentric body 21 is formed with the corresponding surface irregularities. Engagement between the two surface irregularities increases friction between the second guide 24 and the eccentric body 21 so that undesirable rotation of the adjustment shaft 18 during nailing operations is prevented. The urging force of the spring 25 increases sureness of engagement between the first guide 22 and the eccentric body 21, further preventing unwanted rotation of the eccentric body 21.

The operation of the adjustment mechanism 17 will be described while referring to FIGS. 8(*a*) through 10. As mentioned previously, pressing the tip 15 of the push lever 14 against the workpiece will raise the upper tip 16 of the push lever 14 upward into abutment with the first guide 22.

In a case where the eccentric body 21 has an angular rotational position shown in FIG. 8(*a*), the first guide 22 is at its highest position. With this state, pressing the lower tip 15 of the push lever 14 against the workpiece will raise the upper tip 16 of the push lever 14 upward into abutment with the first guide 22. In other words, the upper tip 16 can be moved to the highest position, so that the lower tip 15 of the push lever 14 and the lower tip 9 of the nose 8 can become flush with each other as shown in FIG. 8(*b*). In this case, the upper tip 16 of the push lever 14 is out of engagement with the protrusion 13 of the trigger 12. Therefore, the trigger 12 can be pulled. In this condition, pulling the trigger 12 will raise the plunger 11 upward, thereby triggering the trigger valve 10 and firing the pneumatic nailing machine. Nails will be driven into the workpiece to the maximum possible depth, since the distance between the push lever tip 15 and the nose tip 9 is the smallest.

Figure 9A:
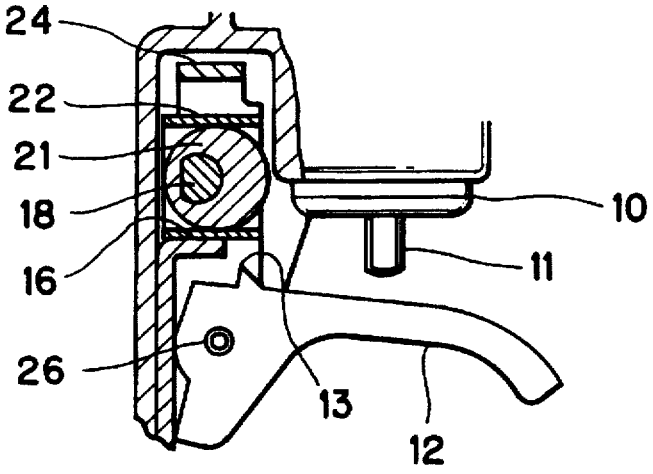
FIG. 9(*a*) is a cross-sectional view showing an intermediate position of the first guide according to the embodiment.
Figure 9B:
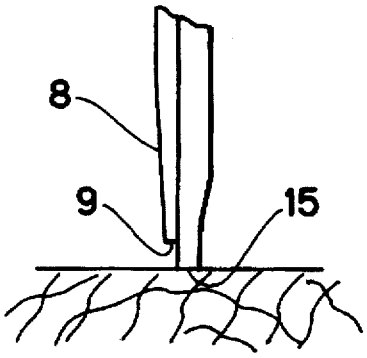

When the tip 15 of the push lever 14 is pressed against the workpiece while the eccentric body 21 is in the reclining condition shown in FIG. 9(*a*), the upper tip 16 of the push lever 14 will rise out of engagement with the protrusion 13 until it abuts against the first guide 22 while the tip 9 of the nose 8 is separated from the surface of the workpiece by the maximum possible distance as shown in FIG. 9(*b*). In this condition, nails will be driven to a minimum depth.

Figure 10:
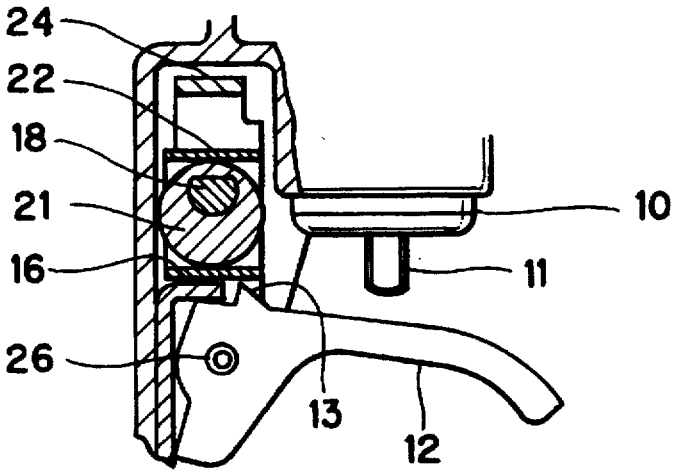
FIG. 10 is a cross-sectional view showing the lowest position of the first guide for preventing pivotal motion of a trigger according to the embodiment of this invention.

When the posture of the adjustment shaft 18 brings the eccentric body 21 into the posture shown in FIG. 10, the upper tip 16 of the push lever 14 will almost touch the first guide 22 even when the lower tip 15 of the push lever 14 is not pressed against the workpiece. That is, the upper tip 16 of the push lever 14 can not rise out of engagement with the protrusion 13 even when the lower tip 15 is pressed against the workpiece. Therefore, in this condition the trigger 12 can not be operated because the upper tip 16 of the push lever 14 is maintained in engagement with the protrusion 13 of the trigger 12.

According to the present invention, the adjustment mechanism 17 is provided to the handle 3 near the trigger 12 at a position attainable by fingers of the same hand that holds the handle 3. Therefore, the depth at which nails are driven into a workpiece can be easily adjusted by one hand. This structure also slims down the area around the nose 8 so that operations can be easily performed in narrow areas such as corners.

Figure 1:
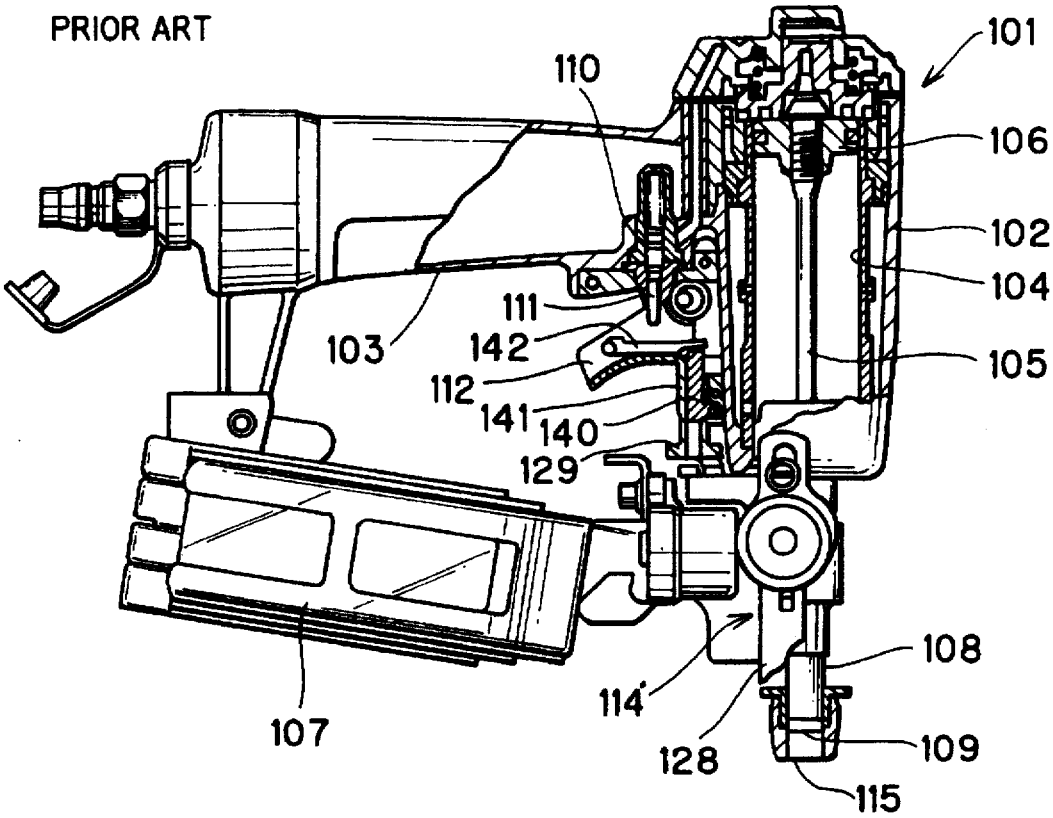
FIG. 1 PRIOR ART
FIG. 1 is a front view partly cross-sectioned showing a conventional pneumatic nailing machine.
Figure 2:
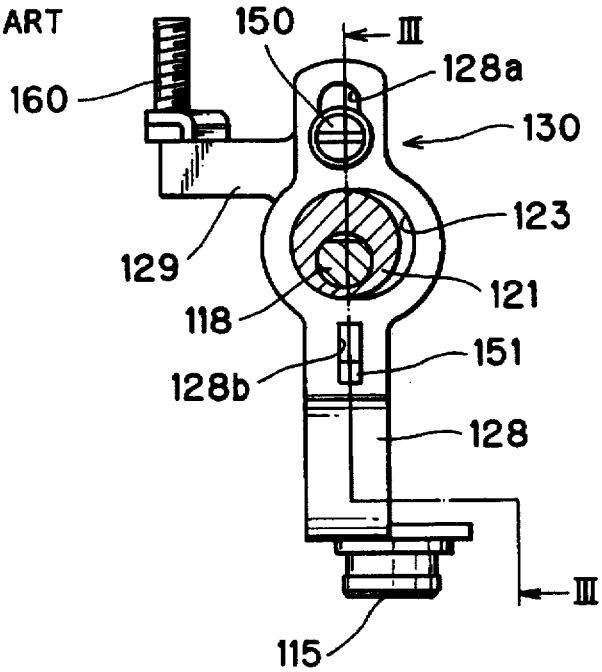
FIG. 2 PRIOR ART
FIG. 2 is a front view showing an essential portion of a push lever in which a first push lever is in a highest position in the conventional pneumatic nailing machine.
Figure 3:
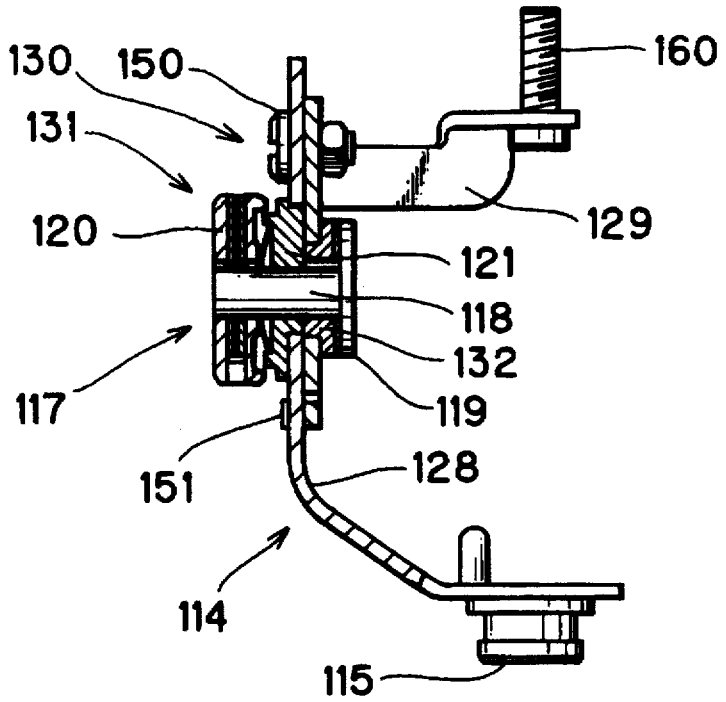
FIG. 3 PRIOR ART
FIG. 3 is a cross-sectional view taken along the line III—III of FIG. 2.
Figure 4:
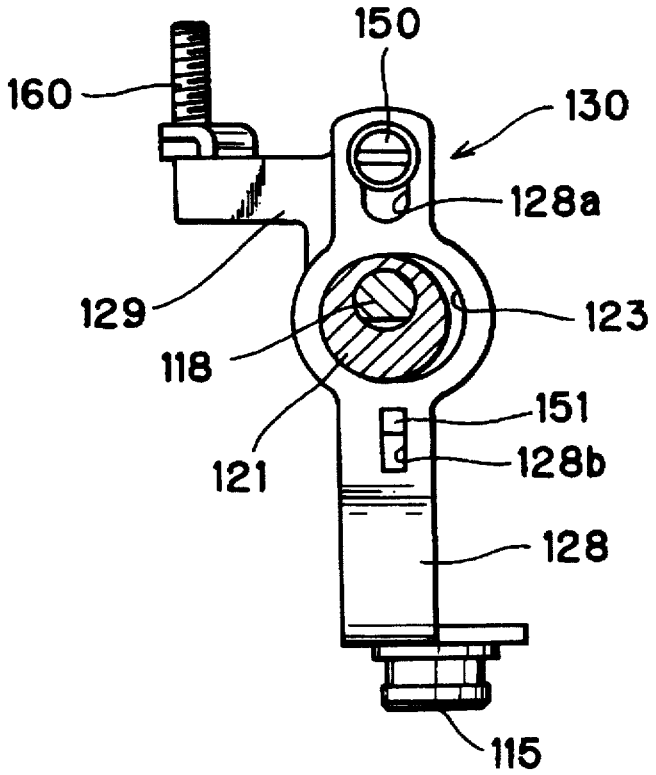
FIG. 4 PRIOR ART
FIG. 4 is a front view showing an essential portion of the push lever in which the first push lever is in the lowest position in the conventional pneumatic nailing machine.

Further, the uppermost moving end position of the push lever 14, when its lower end 15 is pressed against workpiece, is controlled or regulated by the angular rotation of the eccentric body 21 which is positioned above the upper end 16 of the push lever 14. Therefore, a two piece arrangement of the push lever (FIG. 3) is unnecessary, but the push lever 14 can be made from a single integral component, thereby facilitating maintenance. In other words, in the present invention, expansion and shrinkage of the push lever is not required, and therefore, the integral push lever can be provided.

Additionally, the adjustment mechanism 17 can prevent the push lever 14 and the trigger 12 from being operated (FIG. 10). Therefore, accidental firings caused by accidental operation of the push lever 14 or the trigger 12 are prevented, further increasing the safety of the pneumatic nailing machine.

While the invention has been described in detail with reference to the specific embodiment thereof, it would be apparent to those skilled in the art that various changes and modifications may be made therein without departing from the scope of the invention.

For example, in the present embodiment, the adjustment shaft 18 can be removed by pulling out the pin 27 and detaching the knob 20 from the adjustment shaft 18. However, the knob 20 and the adjustment shaft 18 could be made as a single integrated unit. In this case, the adjustment shaft 18 could be removable by replacing the flange 19 with a detachable component, such as a rubber ring engaged in a groove formed to that tip of the adjustment shaft 18. Further, in the illustrated embodiment, the semicircular portion of the adjustment shaft 18 engages the eccentric body 21 for integral rotation and for disassembly. However, key connection can be made between the adjustment shaft and the eccentric body for the relevant purpose. Furthermore, in the present embodiment, the first guide 22 contributes a flat surface for the surface of the upper tip 16 of the push lever 14 to abut against. However, the first guide 22 can be omitted from the mechanism so that the upper tip 16 of the push lever 14 will directly abut against the outer periphery of the eccentric body 21. Furthermore, in the present embodiment, the compression spring 25 is used to strongly abut the second guide 24 against the eccentric body 21. However, another resilient or elastic member such as a leaf spring and a rubber mass could be used to achieve the same results.

What is claimed is:

1. A pneumatic nailing machine for driving a nail into a workpiece, the pneumatic nailing machine including:

a main body;

a handle extending from the main body;

a nose provided to the main body, the nail being protrudable from the nose;

a trigger pivotally supported to the main body and positioned close to the handle for starting a nail driving operation;

a push lever vertically movably supported to the main body, the push lever having a lower tip portion positioned near the nose and an upper tip portion positioned near the trigger;

a driving rod supported in the main body and movable in an axial direction thereof, the driving rod being moved along the nose upon manipulation of the trigger;

a nail driving depth controlling mechanism for controlling a distance between a lower tip end of the nose and a lower tip end of the push lever when the push lever is pressed against the workpiece; and the improvement comprising;

the nail driving depth controlling mechanism having an adjustment means for defining an uppermost limit of movement of the push lever, the adjustment means being positioned near the handle and being positioned on an opposite side of the trigger from a side on which the lower tip end of the nose is located.

2. The pneumatic nailing machine as claimed in claim 1, wherein the push lever comprises a one piece member.

3. The pneumatic nailing machine as claimed in claim 2, wherein the adjustments means comprises an eccentric body rotatably supported in the main body, an eccentric rotation of the eccentric body changing a vertical position of the eccentric body, the eccentric body being positioned above the upper tip portion of the push lever, and a position of the upper tip portion of the push lever being regulated by the position of the eccentric body.

4. The pneumatic nailing machine as claimed in claim 3, wherein the adjustment means further comprises;

a rotation shaft rotatably extending through the main body, the rotation shaft having one end, the eccentric body being mounted on the rotation shaft in an eccentric fashion; and a knob connected to the one end of the rotation shaft.

5. The pneumatic nailing machine as claimed in claim 4, wherein the adjustment means further comprises:

a first guide positioned to surround the eccentric body, the first guide having a U-shape cross-section consisting of a plate like flat wall and an opening end;

a second guide positioned to surround the first guide and to guide the movement of the push lever, the eccentric body having one surface in contact with the second guide through the opening of the first guide; and a biasing member connected to the eccentric body for urging the eccentric body to a direction toward the second guide through the opening of the first guide.

6. The pneumatic nailing machine as claimed in claim 5, wherein the one surface of the eccentric body is formed with a surface irregularities, and an area of the second guide in contact with the one surface is formed with a corresponding surface irregularities for ensuring surface engagement therebetween.

7. The pneumatic nailing machine as claimed in claim 3, wherein the eccentric body provides a lowermost vertical position for providing a lowermost vertical position of the upper tip portion of the push lever, and wherein the trigger comprises a locking portion engageable with the upper tip portion of the push lever when the eccentric body provides the lowermost vertical position, whereby pivotal movement of the trigger is prevented.

8. The pneumatic nailing machine as claimed in claim 1, wherein the adjustment means is disposed adjacent to the handle near the trigger.

9. The pneumatic nailing machine as claimed in claim 1, wherein the adjustment means comprises means for preventing operation of the push lever and in turn the trigger.

10. A pneumatic nailing machine for driving a nail into a workpiece, the pneumatic nailing machine including:

a main body;

a handle extending from the main body;

a nose provided to the main body, the nail being protrudable from the nose;

a trigger pivotally supported to the main body and positioned close to the handle for starting a nail driving operation;

a push lever vertically movably supported to the main body, the push lever having a lower tip portion positioned near the nose and an upper tip portion positioned near the trigger;

a driving rod supported in the main body and movable in an axial direction thereof, the driving rod being moved along the nose upon manipulation of the trigger;

a nail driving depth controlling mechanism for controlling a distance between a lower tip end of the nose and a lower tip end of the push lever when the push lever is pressed against the workpiece; and the improvement comprising;

the nail driving depth controlling mechanism having an adjustment mechanism, the adjustment mechanism comprising an eccentric body rotatably supported in the main body, an eccentric rotation of the eccentric body changing a vertical position of the eccentric body, the eccentric body being positioned above the upper tip portion of the push lever, and a position of the upper tip portion of the push lever being regulated by the position of the eccentric body, such that said adjustment mechanism defines an uppermost limit of movement of the push lever, the adjustment mechanism being positioned near the handle and being positioned on an opposite side of the trigger from a side on which the lower tip end of the nose is located.

* * * * *